United States Patent [19]

McGonigal et al.

[11] 4,211,099

[45] Jul. 8, 1980

[54] APPARATUS FOR MAKING SLOTTED BEAM CONTACT ELEMENTS

[75] Inventors: Charles McGonigal, Grayson; James E. Voytko, Atlanta, both of Ga.

[73] Assignee: Western Electric Company, Inc., New York, N.Y.

[21] Appl. No.: 965,538

[22] Filed: Nov. 30, 1978

Related U.S. Application Data

[60] Division of Ser. No. 822,969, Aug. 8, 1977, Pat. No. 4,136,628, which is a continuation-in-part of Ser. No. 710,358, Jul. 30, 1976, abandoned.

[51] Int. Cl.[2] ..... B21D 28/10

[52] U.S. Cl. ..... 72/47; 72/337; 72/339; 113/119; 29/882

[58] Field of Search ..... 113/119; 72/46, 47, 72/332–341; 29/629, 630 R, 630 B, 630 D

[56] References Cited

U.S. PATENT DOCUMENTS

| | | | |
|---|---|---|---|
| 3,027,536 | 3/1962 | Pasternak | 339/97 |
| 3,112,147 | 11/1963 | Pferd et al. | 339/97 |
| 3,259,873 | 7/1968 | Parkinson et al. | 339/97 |
| 3,394,454 | 7/1968 | Logan | 29/629 |
| 3,496,522 | 2/1970 | Ellis, Jr. et al. | 339/99 R |
| 3,587,502 | 6/1971 | Murray | 113/119 |
| 3,594,714 | 7/1971 | Paulus | 339/242 |
| 3,611,264 | 10/1971 | Ellis, Jr. | 339/99 R |
| 3,772,635 | 11/1973 | Frey et al. | 339/99 R |
| 3,798,587 | 3/1974 | Ellis, Jr. et al. | 339/97 P |
| 3,858,158 | 12/1974 | Henn et al. | 339/99 R |
| 3,943,625 | 3/1976 | Brenan et al. | 113/119 |

*Primary Examiner*—Carl E. Hall

*Attorney, Agent, or Firm*—E. W. Somers

[57] ABSTRACT

A slotted beam contact element for an electrical connector is constructed by forming an opening in a metallic strip and applying forces to at least one portion of the strip adjacent the opening to reshape said portion. Then a bifurcated beam is formed in the strip with at least portions of the furcations of the beam encompassing the opening after which the furcations are moved toward each other to cause the portions encompassing the opening to define a slot of predetermined width characteristics suitable for receiving an insulated conductor and for establishing electrical contact between the conductor and the furcations. For some uses of these kinds of contact elements, selected portions of the furcations may be coated or plated and/or heat treated prior to moving the furcations to their final closed position.

12 Claims, 17 Drawing Figures

APPARATUS FOR MAKING SLOTTED BEAM CONTACT ELEMENTS

CROSS-REFERENCE TO RELATED APPLICATION

This is a division, of application Ser. No. 822,969 filed on Aug. 8, 1977, now U.S. Pat. No. 4,136,628 which is a continuation-in-part of Application Ser. No. 710,358 filed July 30, 1976 and now abandoned.

BACKGROUND OF THE INVENTION

1. Field of the Invention

This invention relates to the manufacture of slotted beam contact elements for an electrical connector, and, more particularly, to the manufacture of insulation-penetrating, bifurcated beam contact elements from a metallic strip in which the furcations of the beam are formed in a manner which permits controlled processing of portions of the strip which are destined to form the surfaces of the furcations that engage a conductor.

2. Prior Art

In the telephone industry where it becomes necessary to interconnect seemingly countless numbers of insulated conductors, a solderless, slotted beam type electrical connector is widely used. This type of connector generally includes an electrically conductive element, which is commonly referred to as a slotted beam contact element and which comprises a base portion having a beam extending from opposite sides thereof with each of the beams bifurcated to form a slot for receiving an insulated conductor. See, for example, U.S. Pat. No. 3,027,536, issued Mar. 27, 1962, to J. P. Pasternak. The spacing between the furcations of each beam is such that opposing surfaces thereof which define the slot penetrate the insulation of an insulated conductor which is moved into the slot to establish electrical engagement between the conductor and the furcations. Because of the resiliency of the bifurcated portions of the beam, they tend to move toward each other after a conductor has been moved into the slot to clamp the conductor tightly.

In the prior art, slotted beam contact elements have been formed along a strip of metal by the step of punching the strip to form central base portions having beams extending bilaterally thereof. For those connectors destined to be used in systems in which conductors are frequently moved into and out of the connectors (see for example, U.S. Pat. Nos. 3,112,147 issued Nov. 26, 1963 to W. Pferd et al, and 3,798,587 issued Mar. 19, 1974 to B. C. Ellis, Jr., et al), each beam is lanced to bifurcate the beam with opposing lanced surfaces of the furcations defining a conductor-receiving slot. The step of lancing to bifurcate each beam invariably moves one of the furcations out of the plane of the contact element thereby impairing the connection process when a conductor is moved into the slot. Also, the step of lancing the beams to form the furcations in their final position makes it difficult to control the shape of the opposing lanced surfaces of the furcations which define the slot, and forms burrs on the lanced surfaces which deform a conductor that is moved into the slot. For those connectors which are to be used in systems in which connections are not made repeatedly (see, for example, U.S. Pat. No. 3,858,158 issued on Dec. 31, 1974 in the names of R. W. Henn et al), each conductor-receiving slot is formed by the punching of a narrow slot in a beam; however, difficulties have been encountered in punching narrow width slots through relatively thick strips of metal.

Since the conductors which are connected with insulation-penetrating slotted beam contact elements are used in a variety of systems where they are exposed to a wide range of temperature conditions and/or physical abuse such as, for example, wind loading in outside plant systems or solder heat in central offices, the conductors are insulated with different materials which are capable of withstanding particular conditions. Rather than manufacture different kinds of slotted beam contact elements which are usable with different types of insulation, it is more economical to manufacture a contact element which is capable of tearing, penetrating or slicing through a variety of types of insulation to establish an electrical connection and which is capable of maintaining a tight connection over a period of time. This is accomplished by shaping the opposing surfaces of the bifurcated beam portions to a predetermined configuration; however, as noted hereinbefore, the satisfactory shaping of these surfaces has not been possible when the furcations are formed by the step of lancing or by the forming of a narrow slot in the beam.

Also, it may be important that selected surfaces of these kinds of contact elements be plated with a corrosion-resistant material such as, for example, gold or solder. In contact elements of the type shown in U.S. Pat. No. 3,858,158 the narrow slot punched out in each beam facilitates, to a limited extent, the plating of the opposing walls of the furcations which define the slot, while in U.S. Pat. No. 3,394,454 issued July 30, 1968 in the name of A. Logan, portions of the inner edge surfaces of the conductor-receiving slot are coined to space apart the bifurcated portions and to facilitate the plating of the edge surfaces. However, the use of coining to space apart the furcations is not altogether satisfactory because of the control required to achieve the final slot width required for a suitable electrical connection with a conductor.

Although the prior art discloses contact elements having opposing jaw portions which are moved toward each other to engage a conductor (see, for example, U.S. Pat. No. 3,259,873), it is not desirable to close the bifurcated portions of a connector, which is mounted in a plastic housing, upon a conductor after it has been inserted between the bifurcated portions. Also, because of the possibility of uunwanted metal flow, it is not desirable to shape the opposing faces of the slot walls after the furcations have been formed (see, for example, U.S. Pat. No. 3,587,502), unless elaborate physical restraints are imposed. It is much more desirable to be able to manufacture a slotted beam connector with the slot pre-sized to receive the conductor and with the walls of the slot processed prior to the formation of the furcations.

SUMMARY OF THE INVENTION

The foregoing problems are overcome by the apparatus of the present invention, wherein the making of a slotted beam contact element includes forming an opening in a metallic strip, and applying forces to at least one portion of the strip adjacent the opening to reshape that portion, then a bifurcated beam is formed in the strip with at least portion of the furcations encompassing the opening, and the furcations are moved toward each other to cause the portions encompassing the opening to define a slot of predetermined width characteristics suitable for receiving an insulated conductor and for establishing electrical contact between the furcations and the conductor.

By means of the foregoing, the furcations of each beam are maintained in one plane and the surfaces of the furcations which form the conductor-receiving slot advantageously may be shaped in order to improve the initial and prolonged electrical contact of the furcations with a conductor. Because of the accessibility of the contact surfaces when the furcations are in the open position, the surfaces may be treated, such as, for example, by plating in order to enhance their electrical contact. The furcations are moved from an open position, whereat the above-described operations are performed, to a closed position in which the slot has predetermined width characteristics suitable for enhancing the electrical contact.

In accordance with the invention, an apparatus for making a slotted beam contact element includes facilities for forming an opening in a metallic strip, and facilities such as, for example, coining tools, for applying forces to at least one portion of the strip adjacent the opening to reshape the portion. The apparatus also includes means for forming a bifurcated beam in the strip with at least portions of the furcations of the beam encompassing the opening, and facilities for moving the furcations toward each other to cause the portions encompassing the opening to define a slot of predetermined width characteristics suitable for receiving an insulated conductor and for establishing electrical contact between the furcations and the conductor.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION OF THE INVENTION

Figure 1A:
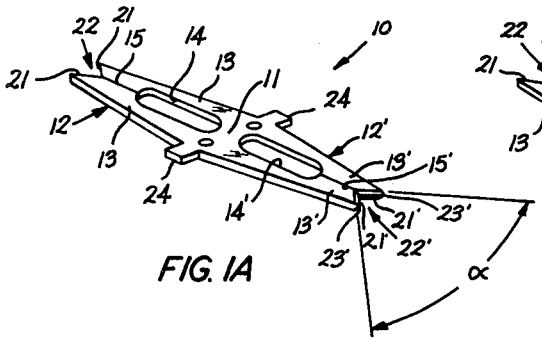
FIG. 1A is a perspective view of an insulation-penetrating slotted beam contact element in a completed stage of manufacture having a conductor-receiving slot of predetermined characteristics.
Figure 3A:
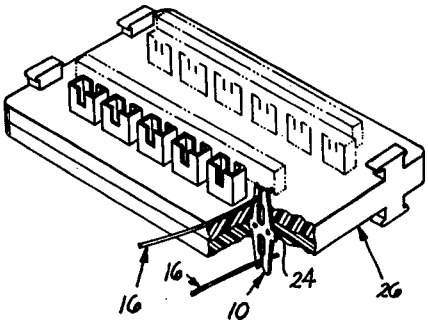
FIGS. 3A and 3B are perspective views of electrical connecting systems which include a plurality of the slotted beam contact elements shown, for example, in FIG. 1A and mounted within a dielectric housing.
Figure 3B:
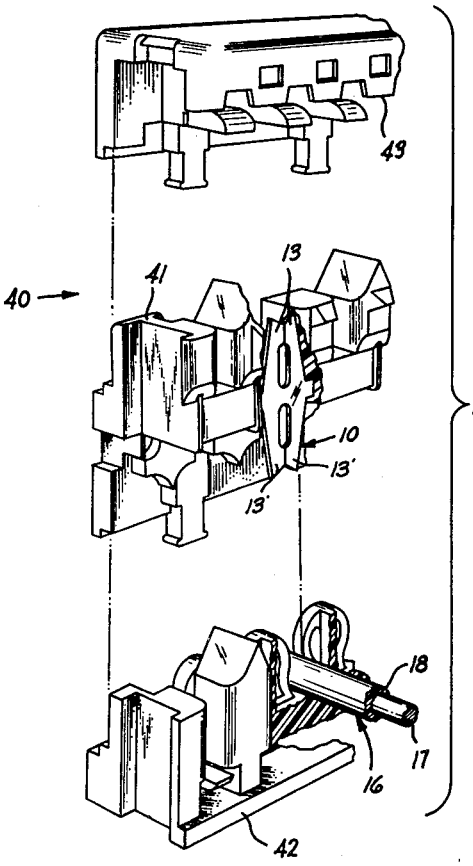

Referring now to FIG. 1A, there is shown an insulation-penetrating, slotted beam contact element, designated generally by the numeral 10, which is an insulation-penetrating electrically conductive element and which has a central base portion 11 and two beams 12 and 12' extending bilaterally therefrom. Each of the beams 12–12' is bifurcated to form furcations 13—13 and 13'—13', respectively, with inner portions forming enlarged elongated openings 14–14' adjacent the base 11 and with outer portions closing towards each other to form slots 15–15' having predetermined width characteristics for receiving insulated conductors 16–16'. The insulated conductor 16 typically includes a conductive element or wire 17 covered with an insulation 18 such as, for example, polyethylene or polypropylene (see FIGS. 3A and 3B). The outermost ends of each of the furcations 13—13 and 13'—13' are tapered along surfaces 21—21 and 21'—21' so as to form V-shaped entrances 22–22' to the conductor-receiving slots 15–15'. The capability of the entrance portions 22 and 22' of the contact elements 10—10, for example, to cut through the insulation covering of an insulated conductor 16 is determined by the included angle $\alpha$ between the surfaces 21—21 and 21'—21' which form the flared entrances and by the shape of the surfaces 21—21 and 21'—21' (see for example, beveled edges 23–23' formed on the surfaces 21'—21'). In order to support the contact element 10 against unintended movement within a dielectric housing 26 (se FIG. 3A), a pair of arms 24—24 extend laterally from the central body portion 11. Contact elements having a bifurcated beam are shown, for example, in a wire connector 40 which includes a connector module 41, an index strip 41 and a cap 42 and which is disclosed and claimed in earlier identified U.S. Pat. No. 3,858,158 issued Dec. 31, 1974 in the names of R. W. Henn, C. Scholly, J. E. Voytko, T. L. Williford, Jr. and C. McGonigal (see FIG. 3B). See also priorly identified U.S. Pat. Nos. 3,772,635 and 3,798,587.

Figure 2:
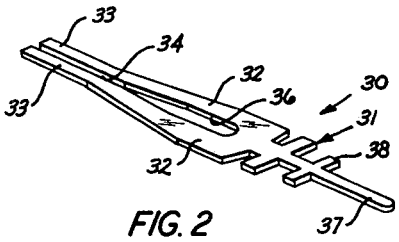
FIG. 2 is another type of slotted beam contact element which also may be constructed in accordance with the principles of this invention.

Another slotted beam contact element, designated generally by the numeral 30, is shown in FIG. 2 and is disclosed and claimed in copending application Ser. Nos. 710,019 and 710,020 filed on July 30, 1976 in the name of T. J. Gressitt and assigned to Bell Telephone Laboratories, Inc. The contact element 30 has furcations 32—32 extending unilaterally from a base portion 31 with free end portions 33—33 forming a conductor-receiving slot 34 and a generally rectangularly-shaped member 37 extending from the base portion for use in making, for example, a wire wrap connection.

The contact elements 10 and 30 are suitable to accommodate a range of insulated conductors without permanent deformation or misalignment of the furcations 13—13 and 32—32. The material from which the contact elements are typically constructed, i.e. Phosphor-bronze or spinodal copper alloy, has a favorable ratio of yield stress to Young's modulus of elasticity which permits the furcations to be flexed without exceeding the elastic limit of the material.

Figure 1B:
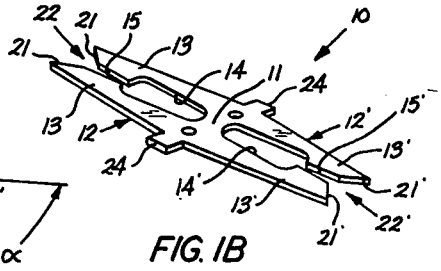
FIG. 1B is a perspective view of the contact element of FIG. 1A in an intermediate stage of manufacture.
Figure 4A:
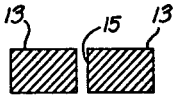
FIGS. 4A–4E show several configurations of opposing surfaces of furcations of a bifurcated beam of the slotted beam contact element of FIG. 1 which form the conductor-receiving slot.
Figure 4B:
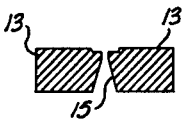
Figure 4C:
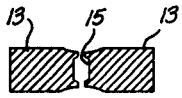
Figure 4D:
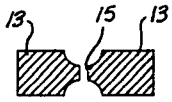
Figure 4E:
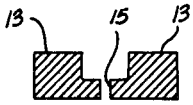

The methods of this invention, unlike prior art methods, are designed to produce a bifurcated beam contact element 10, for example, with conductor-engaging surfaces which define the conductor-receiving slots 15—15 being deformed controllably and precisely with minimum tolerances to a desired configuration (see for example FIGS. 4A-4E) prior to the formation of the furcations 13—13 and 13—13 of the beams and prior to the movement of the furcations 13—13 and 13'—13' from the "open" position shown in FIG. 1B to a final "closed" position shown in FIG. 1A. The stepped configuration shown in FIG. 4E is highly efficient in being able to penetrate the insulation of a hard material, for example, such as polypropylene. Predetermined width characteristics of the conductor-receiving slot 15 is interpreted to mean that the portions of the furcations 13—13, for example, may be spaced apart throughout that length thereof which defines the conductor-receiving slot, or for part of the length, or contiguous to each other, and it is to be understood that the configuration of the contact element 10 shown in FIG. 1A is exemplary only. An apparatus, designated generally by the numeral 49, for carrying out the principles of this invention will be described with respect to the manufacture of the contact elements 10—10, but it will be understood to apply as well to other slotted beam contact elements such as, for example, the contact elements 30—30.

Figures 5, 6A, 6B, 6C, 9:
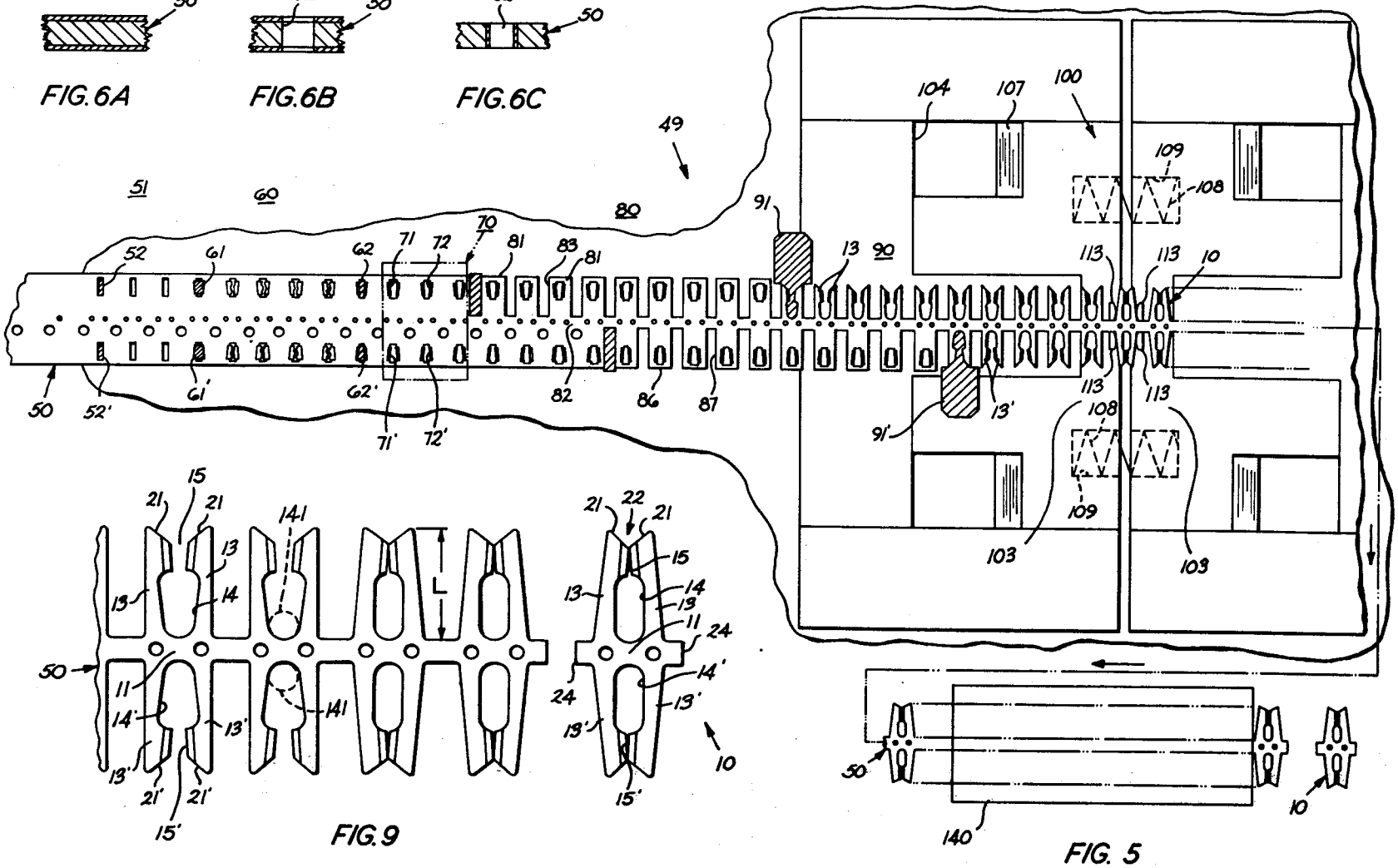
FIG. 5 is a plan view of an apparatus for forming the slotted beam contact element shown in FIGS. 1A and 1B.
FIGS. 6A–6C show a series of views illustrating one sequence of steps for the plating of opposing surfaces of portions of the furcations.
FIG. 9 shows an enlarged view of one type of a slotted beam contact element in successive stages of manufacture in accordance with the principles of this invention.

As can best be seen in FIG. 5, a metallic strip 50 is advanced incrementally by an indexing mechanism (not shown) from left to right through a plurality of work stations, the first one of which is a station 51 whereat apertures 51-52' are formed on opposite sides of a longitudinal centerline of the strip. Then, successive sections of the strip 50 are advanced into a station 60 whereat tools 61-61' are operated to deform, e.g. coin, at least portions of opposing surfaces 71-72 and 71'-72' of the apertures 52-52' respectively, which are destined to become the opposing surfaces of the furcations 13-13' that define the slots 15-15' to one of the configurations shown, for example, in FIGS. 4A-4E. One of the advantages of forming the apertures 52-52' in the strip 50 is to provide space for metal flow during the coining operation. Further, the metal of the strip 50 itself outside and adjacent those areas being coined provides constraint for the metal being moved. Following the coining, tools 62-62' are operated to trim the rough edges of the flowed metal to a predetermined configuration; however, in certain applications this step may be omitted in order to take advantage of the irregularities in the coined edges to enhance the electrical contact with a conductor 16 which is moved into the slot 15 or 15'.

The spacing between the opposing surfaces 71-72 and 71'-72' of the aperture 52-52' must be sufficient to permit the coining of the opposing edge surfaces of the furcations to a desired configuration such as one shown, for example, in FIGS. 4A-4E and in some instances to permit a controlled plating of at least the surfaces destined to define the conductor-receiving slots 15-15'. Also, in order to conform to acceptable metal forming practices and to avoid undue breakage of punches which are used to subsequently form the furcations 13—13 and 13'—13', the initial spacing between the opposing surfaces 71-72 and 71'-72' should be at least equal to the thickness of the strip 50. These requirements on the spacing between the opposing surfaces 71-72 and 71'-72' of the apertures 52-52' which become opposing surfaces of the furcations 13—13 and 13-13' must be balanced against a desire to minimize the amount of movement of the furcations when they are moved from the "open" position (see FIG. 1B) to the "closed" position (see FIG. 1A). In one embodiment, the outermost portions of the furcations 13—13 or 13'—13' are spaced apart a distance of about 0.108 inch at this stage in the manufacturing process.

In the next step of a preferred embodiment of this invention as applied to the manufacture of the contact elements 10—10, the strip 50 is advanced incrementally through an apparatus 70 whereat selected portions of the strip, e.g. opposing surfaces 71 and 72 and opposing surfaces 71' and 72' of the apertures 52-52', respectively, which are destined to define the conductor-receiving slots 15 and 15' have a layer of suitable metal or alloy such as, for example, solder, deposited thereon. It will be understood that the term "metal" as used hereinafter is intended to define a single metallic element or a mixture of metallic elements. In one embodiment (see FIGS. 6A-6C), the plating of the surfaces 71-72 and 71'-72' is begun by masking the strip 50 either mechanically, with tape, or with an electroplating resist material, i.e. an electroplating "stop-off", such as, for example, a lacquer, which is coated onto at least the major surfaces of the strip. The openings 52-52'are punched in the strip 50 in the station 60 and then unmasked portions, i.e., the opposing surfaces 71-72 and 71'-72', are plated with a metal at the station 70 after which the masking is removed.

The strip 50 is advanced from the station 70 through a station 80 where one longitudinal edge portion of the strip is formed first with beams 81—81 extending from a central base 82 with spaces 83—83 therebetween, and the opposed edge portion formed with alternating beams 86—86 and spaces 87—87. The beams 81—81 and 86—86 are destined to become the beams 12 and 12', respectively, of each completed contact element 10, with the distance between successive ones of beams 81—81 and 86—86 preferably equal at least to the thickness of the strip 50 to avoid undue punch breakage. Subsequently, the strip 50 is advanced through a work station 90, where work tools 91—91 form the furcations 13—13 and 13'—13' while preserving the furcations in the "open" position spaced substantially further apart than is required in the final configuration.

Figure 7:
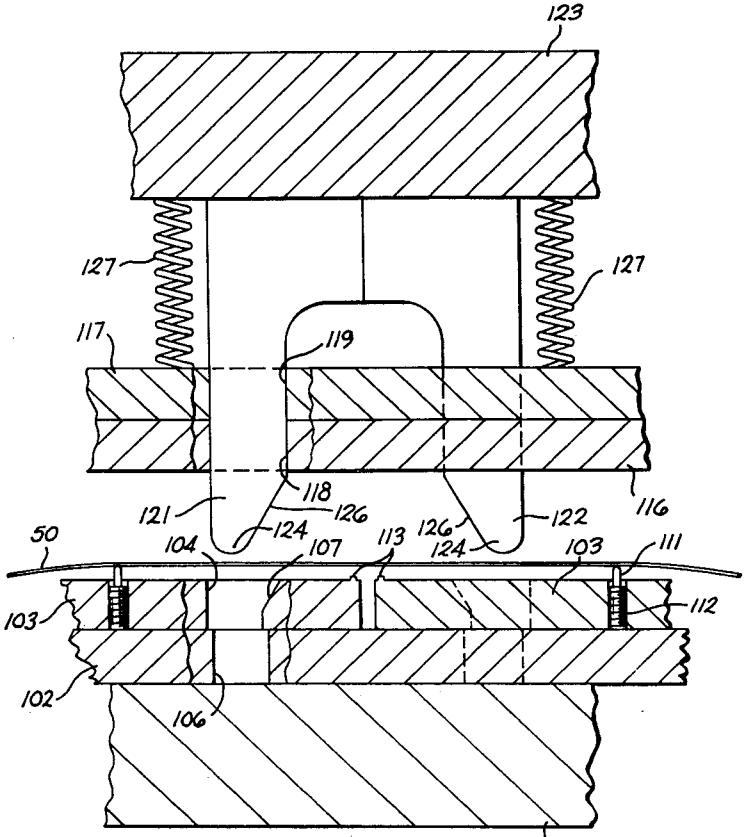
FIG. 7 is an enlarged detail view of a portion of the apparatus shown in FIG. 5 which is used subsequent to the shaping of the furcation surfaces to move the furcations toward one another to form a slot of predetermined characteristics.

The strip 50 is advanced to move the partially formed contact elements 10—10 into a work station, designated generally by the numeral 100 (see FIGS. 5 and 7), where they are formed into the final as-manufactured configuration shown in FIG. 1A. The work station 100 includes a platen 101 for supporting a stationary plate 102 and a pair of plates 103—103 movable with respect to and mounted contiguous the plate 102. Each of the plates 103—103 has an opening 104 defined partially by a camming surface 107 and which in the position shown in FIG. 7 is misaligned with an associated opening 106 in the stationary plate 102. Further, the plates 103—103 are held spaced apart in the direction of advance of the strip 50 by springs 108—108 disposed within blind bores 109—109 in the plates.

As the strip 50 is advanced incrementally through the station 100, it is supported slightly above the plate 103 (see FIG. 7) by spring-loaded pins 111—111 mounted reciprocally in bores 112—112 and constructed of a material such as Teflon Plastic. This permits the strip 50 to be advanced into and out of the work station 100 notwithstanding the protrusion of closing lugs 113—113 upstanding from and attached to the plates 103—103.

When the strip 50 is advanced incrementally, one of the partially formed contact elements 10—10 is positioned with the lugs 113—113 adjacent the beams 12—12 of the contact element at approximately the mid-point of the unsupported length of the furcations 13—13 and 13'—13'. The location of the application of the forces for closing the furcations 13—13 and 13'—13' through the lugs 113—113 is determined with respect to the "springback" characteristics of the furcations. A stress and deflection analysis has revealed that the force and resultant deflection for incipient yielding at the base of each of the furcations 13—13 and 13'—13' are directly proportional to the yield strength of the material from which the contact element is constructed. As the location of the forces applied to the furcations 13—13 and 13'—13' is moved further from the base 11, the force required to produce yielding at the furcation base decreases and the so-called elastic "springback" or elastic deformation of the furcations at the top of the slot increases. It has been found that suitable force application points are about 0.075 inch to 0.100 inch from the base 11 of a contact element 10 such as that shown in FIG. 1A made from a spinodal alloy and having a 0.420 inch length between free ends of the furcations.

Contact elements 10—10 of the type shown in U.S. Pat. No. 3,858,158 are manufactured in an initial configuration which requires a total plastic deflection of about 0.0093 inch, for example, of each furcation 13 and 13'. It does not appear necessary that the furcations 13—13 and 13'—13' be brought completely together in order to allow the "springback" to cause the beam to move to the final desired position. It has been found that in order to be able to use connectors of the type shown in FIG. 3A made of a particular material, i.e. spinodal copper alloy, with all expected gauge size conductors, the spacing between the furcations 13—13 an 13'—13' should increase from about 0.002 inch at their outer extremeties inwardly toward the slots 14 and 14'. After a conductor 16 is moved into a conductor-receiving slot 15, it has been found that the beams are deflected outwardly so that the final slot has generally parallel walls.

A pair of stripper plates 116 and 117 (see FIG. 7) having aligned opening 118 and 119, respectively, are mounted adjacent the plates 103—103 and spaced slightly therefrom to permit the strip 50 of partially formed contact elements 10—10 to be advanced between the plates 116 and 103. The openings 118 and 119 which are partially aligned with the openings 106 in the plate 102 and misaligned slightly from the openings 104—104 in the plates 103—103 are designed to receive camming members 121 and 122 depending from a reciprocally mounted ram 123. Further, the lowermost end of each member 121 and 122 has a rounded portion 124 and a camming surface 126 adapted to mate and move slidably along the surface 107. A pair of compression springs 127—127 are interposed between the ram 123 and the stripper plate 117 so that when the ram 123 is moved downwardly, the members 121 and 122 are moved downwardly a distance prior to the downward lagging movement of the stripper plates 117 and 116.

Figure 8:
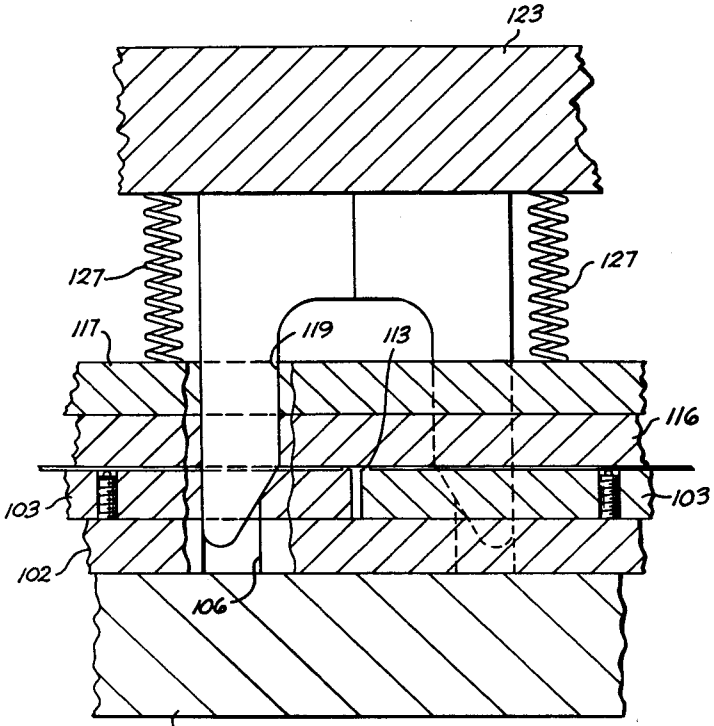
FIG. 8 is an enlarged detail view of the portion of the apparatus shown in FIG. 7 after having been operated to apply forces to the bifurcated portions.

In operation, one of the partially formed contact elements 10—10 is positioned in alignment with the work station 100. The ram 123 is moved downwardly to urge the camming members 121 and 122 through the openings 119 and 118 in the juxtaposed stripper plates 117 and 116, respectively and then to cause the rounded portions 124—124 of the members 121 and 122 to enter the openings 104—104 in the movable plates 103—103. The camming surfaces 126—126 of the members 121 and 122 engage the camming surfaces 107—107 in the openings 104—104 of the plates 103—103 to overcome the springs 108—108 and cause the plates 103—103 to be moved toward each other (see FIG. 8). The downward movement of the ram 123 also, after a predetermined lag occasioned by the springs 127—127, causes the plates 116 and 117 to be moved downwardly. The plate 116 overcomes the spring bias of the pins 111—111 and causes them to be moved into the bores 112—112 to permit the plate 116 to carry the strip 50 into confining engagement with the plates 103 (see FIG. 8).

The movement of the plates 103—103 causes closing lugs 113—113 to engage the beams 12-12' of the contact element 10 and causes the bifurcated portions 13—13 and 13'—13' thereof on each side of the central base portion 11 to be moved toward each other with precision to form a gap therebetween of predetermined width characteristics. During the dwell of the ram 123, the contact element 10 is formed to the configuration shown in FIG. 1A. In another embodiment, it has been found that the precision closing of the furcations 13—13 and 13'—13' may be enhanced by inserting a pin 141 (see FIG. 9) into the slots 14-14' prior to the application of forces to the furcations. The pins 141—141 are inserted so as to be in engagement with the innermost rounded portion of the slots 14 and 14'. Then as the ram 123 is moved upwardly to withdraw the depending portions 121 and 122 from the movable plates 103—103, the springs 108—108 are rendered effective to space apart the plates. After a predetermined lag, the springs 127—127 cause the stripper plates 116 and 117 to be moved upwardly out of engagement with the strip 50. This permits the pins 111—111 to be rendered effective to raise the strip 50 out of engagement with the plate 103 and lugs 113—113 so that the strip may be advanced to index the next successive partially formed contact element 10 into the work station 100.

Whereas in the past, the deformation of conductor-engaging surfaces has been limited to those which define the entrance portions 22-22', the technique carried out in accordance with the principles of this invention offers new possibilities for slot profiles and configurations for both improved splicing and beam-to-wire contacts. Permutations of slot walls, ledges and wipe areas can be included to suit any one of a multiple number of requirements. By constructing the contact element 10 in accordance with the principles of this invention, a balance may be struck between oft times opposing considerations such as slice-through characteristics and contact-bearing area for electrical engagement. The thickness of the contact element 10 is selected from the standpoint of strength characteristics and it has been found that in specific embodiments, a conductor contact edge is some optimum fraction of the total thickness (see, for example, FIG. 4E). Further, while typically the configuration of each of the edge surfaces is constant along the length of the conductor-receiving slot 15 or 15', this invention permits of changes to the profile along the length of the slot. Moreover, the ability to move metal freely makes the technique adaptable to a variety of different metals as well as different thicknesses.

In the next step of the preferred sequence of steps in a method embodying the principles of this invention, the strip 50 is advanced through a work station 140 whereat the contact elements 10—10 in the "closed" configuration of FIG. 1A are subjected to heat treatment. For spinodal alloy structures (see *Metals Handbook*, 8th Edition, Vol. 8 pg. 184–185) such as a copper-nickel-tin alloy, the heat treatment is conducted at a suitable temperature for a sufficient length of time to transform the alloy through a spinodal decomposition into a material having high strength characteristics for connecting electrical conductors on a repeated basis. In-line heat treatment in accordance with the preferred sequence which is made possible by suitable processing of the strip 50 prior to its advance through the apparatus 49 is much less time consuming than priorly used batch processes which expose contact elements 10—10 made of a spinodal alloy to a temperature of about 650° F. for about 90 minutes or those made of a Phosphor-bronze to a temperature of about 400° F. for about an hour.

The finally configured contact elements 10—10 are then separated in seriatim from the strip 50 individually or in groups for insertion into any of several types of plastic connecting blocks. In one embodiment, the strip 50 is taken up in a coil which is moved into heat treatment apparatus (not shown) after which the strip is payed out to advance the contact elements 10—10 through a separation station.

The preferred sequence of steps is especially suitable for the manufacture of contact elements 10—10 of the type in which the heat treating temperature for the particular contact element material is below the wetting temperature for the material which is used to plate portions of the contact element e.g. a strip of Phosphor-bronze with portions thereof plated with solder. This difference in temperatures avoids reflow of the plating material when the strip 50 of contact elements 10—10 is subjected to heat treatment. In those instances where the material of the metal strip 50 is such that the heat treatment must be conducted at temperatures substantially above the reflow temperatures of the plating material, the preferred sequence of steps must be modified such that the furcations 13—13 and 13'—13' are closed, heat treated and then plated. For example, a strip 50 made of a spinodal copper alloy having heat treatment temperature of about 650° F. to be plated with solder having a reflow temperature of about 450° F. is taken up on a reel (not shown) following the furcation-closing operation, heat treated by batch process and then payed out in strip form through a plating apparatus.

The methods of this invention also are ideally suited to being able to preload or prestress a contact element 10 while maintaining the desired slot characteristics. In the priorly-identified Logan U.S. Pat. No. 3,394,454, the step of coining is used to preload the connector, but as the impression is increased, the slot width is also increased to the point of being unable to accommodate smaller size conductors. By using the principles of this invention, the contact element may be prestressed while being able to achieve as small a gap as desired, or the furcations 13—13 and 13'—13' may be closed to touch, as shown in FIG. 9, with forces further applied to the furcations in the direction of the slots 15–15', using the contact points as fulcrums, to further preload them.

While this invention is described in terms of a preferred embodiment which includes plating and heat treating as well as the coining of opposing faces of the furcations 13 and 13', for example, the invention is not so limited and may be used to make insulation-piercing, slotted beam contact elements which need not be plated, nor heat treated, nor require additional forming steps such as coining. Further, in those instances when it is desirable to provide a slotted beam connector in which the furcations have been prestressed, the principles of this invention may be used to (a) form the furcations in an "open" position, (b) apply forces to close the furcations into contiguous relationship, then (c) apply the technique shown in U.S. Pat. No. 3,394,454 to space apart and preload the furcations to what is known as a "forced gap". The principles of this invention are also applicable to the construction of contact elements having other than planar configurations, such as, for example, U-shaped connectors. See U.S. Pat. No. 3,821,692 issued June 28, 1974 in the name of R. W. Barnard.

EXAMPLE

The contact element 10 shown in stages of manufacture in FIG. 9 is made from a 0.025 thick spinodal copper alloy material, has an overall length of about 0.420 inch, and width of about 0.168 inch. The slot 14 has a width of about 0.050 inch and the slot 15 has a length of about 0.080 inch. Openings are punched in the strip 50 with opposing surfaces of each opening which are destined to define the conductor-receiving slots 15–15' being plated with solder. In the initial "open" position the furcations 13—13 and 13'—13' of each associated pair are spaced apart an out-to-out distance of about 0.109 inch with the opposed edge surfaces being about 0.033 inch apart adjacent the tapered entrance surfaes 22–22' and decreasing to about 0.027 inch adjacent the enlarged slots 14–14'. As can be seen in FIG. 9, the distance from the innermost portion of the enlarged slot 14 to the rounded portion of the edge surfaces 22—22 which form the flared entrance 23 is designated "L". Desirably, the forces used to close the furcations 13–13' and 13'—13' of each pair are applied to the outside edge surfaces of the furcations at a distance of about L/2 from the base 11. In the final, ready-for-use, "closed" position, the furcations 13—13 and 13'—13' of each pair are essentially touching at the entrance 21 and then open to about 0.006 inch adjacent the enlarged slot 14. Further, the included angle, $\alpha$, between the edge surfaces 21—21 is 90°. The opposing edge surfaces of the furcations 13—13 and 13'—13' are stepped to about half the thickness of the strip 50. The contact elements 10—10 are subjected to a heat treatment at a temperature of about 400° F. and separated from the strip 50 individually or in groups of a predetermined number interconnected together for assembly with a housing constructed of a dielectric material such as those, for example, shown in FIGS. 3A and 3B.

It is understood that the above-described arrangements are simply illustrative of the invention. Other arrangements may be devised by those skilled in the art which will embody the principles of the invention and fall within the scope and spirit thereof.

I claim:

1. An apparatus for making a slotted beam content element, which comprises:

means for forming an opening in a metallic strip;

means for applying forces to at least one portion of the strip adjacent the opening to reshape said portion;

means for forming a bifurcated beam in the strip with at least portions of the furcations of the beam encompassing the reshaped opening; and means for moving the furcations toward each other to cause the portions encompassing the opening to define a slot of predetermined width characteristics suitable for receiving a conductor and for establishing electrical contact between the furcations and the conductor.

2. The apparatus of claim 1, wherein the strip is comprised of a first metal and the apparatus also includes means for depositing a second metal on a surface of the strip which forms a wall of the opening prior to the step of forming a bifurcated beam.

3. An apparauts for making a slotted beam contact element which comprises:

means for forming an opening having opposing walls in a strip comprised of a first metal;

means for depositing a layer of a second metal on the opposing walls of the opening; and means for forming a bifurcated beam in the strip such that the furcations of the beam, which are destined to form a conductor-receiving slot with the opposing surfaces of the furcations being the walls of the opening, encompass the opening and are spaced apart at selected locations along the opposing surfaces at least a predetermined distance; and means for applying forces to the furcations to move the furcations toward each other to define a conductor-receiving slot of predetermined width characteristics suitable for causing the furcations to establish electrical contact with a conductor to be moved subsequently into the conductor-receiving slot.

4. The apparatus of claim 3, wherein the depositing means for the second metal includes means for masking selected surfaces of the strip prior to forming the opening therein;

means for exposing the strip to a plating solution to deposit the layer of a second metal on the unmasked surfaces of the strip which includes at least the opposing walls of the opening; and means for removing the masking means from the strip.

5. The apparatus of claim 4, which includes means effective subsequent to the application of forces to the furcations for subjecting the contact element to heat treatment to provide the contact element with suitable strength characteristics.

6. An apparatus for making a slotted beam electrical contact element which comprises:

means for indexing a strip of metal through a plurality of work stations;

means for forming successive openings on each side of a longitudinal centerline of the strip, each opening including a pair of opposing walls which are destined to define a conductor-receiving slot;

means at one of the work stations for working the strip to form successive interconnected partially formed contact elements, each hving a central base with a bifurcated beam extending from opposite sides of the base and aligned with and encompassing one of the openings such that the opposing walls of each opening form the opposing surfaces of the furcations of the beam which encompasses the opening with the opposing free ends of the furcations of each beam being spaced apart at least a predetermined distance; and means for applying forces to the furcations to move the furcations toward each other to define a conductor-receiving slot of predetermined width characteristics suitable for causing the furcations to establish electrical contact with a conductor to be moved subsequently into the conductor-receiving slot.

7. The apparatus of claim 6, which also includes means rendered effective subsequent to the application of forces to the furcations for subjecting the contact elements to heat treatment.

8. The apparatus of claim 6 which further comprises:

means at the work station at which the forces are applied to the furcations to move the furcations to form the conductor-receiving slot for confining the strip in registration therewith, and wherein the means for applying the forces includes:

means rendered effective at the work station at which the strip is confined for engaging the partially formed contact elements at opposed locations of each of the pairs of furcations; and means for causing the engaging means to be moved relative to the confined portion of the strip to cause the furcations of each beam to be moved toward each other to form a conductor-receiving slot of predetermined width characteristics; and means for subjecting successive sections of the strip to heat-treatment to provide the contact elements with suitable strength characteristics.

9. The apparatus of claim 8, which also includes means for forming the opposing walls of each opening to a predetermined configuration.

10. The apparatus of claim 8, wherein the means for working the strip also includes means for forming an enlarged opening in each of the beams between the central base portion and the conductor-receiving slot, the enlarged opening communicating with the conductor-receiving slot, and also including spaced pins at the station at which the strip is confined, each of the pins aligned with one of the enlarged openings of each successive one of the partially formed contact elements which are advanced into the station;

means mounting the pins for receiprocal movement into and out of engagement with walls of the enlarged openings if the contact element aligned therewith; and means rendered effective prior to the application of forces to the furcations for moving and inserting the pins in the enlarged openings.

11. The apparatus of claim 9, wherein the strip is comprised of a first metal and the apparatus further includes means rendered effective subsequent to the deformation of the opposing walls of each opening for depositing a layer of a second metal on the opposing walls of each opening.

12. The apparatus of claim 11, wherein the means for depositing the second metal includes means effective to forming the openings for masking the strip;

means for depositing the second metal on the unmasked portions of the strip; and means for removing the masking means.

* * * * *